US006068131A

United States Patent [19]

Styron et al.

[11] Patent Number: 6,068,131

[45] Date of Patent: May 30, 2000

[54] METHOD OF REMOVING CARBON FROM FLY ASH

[75] Inventors: Robert William Styron, Marietta, Ga.; Jiann-Yang Hwang, Houghton, Mich.

[73] Assignee: The Board of Control of Michigan Technological University, Houghton, Mich.

[21] Appl. No.: 09/352,594

[22] Filed: Jul. 13, 1999

Related U.S. Application Data

[60] Provisional application No. 60/092,599, Jul. 13, 1998.

[51] Int. Cl.[7] ..... B03D 1/02; B03D 1/006; B03D 1/008

[52] U.S. Cl. ..... 209/166; 252/61

[58] Field of Search ..... 209/166, 167; 252/61; 106/405, DIG. 1, 705

[56] References Cited

U.S. PATENT DOCUMENTS 1,984,386 12/1934 Tschudy .
4,121,945 10/1978 Hurst et al. .
4,426,282 1/1984 Aunsholt .
5,047,145 9/1991 Hwang .
5,227,047 7/1993 Hwang .
5,456,363 10/1995 Groppo et al. .

FOREIGN PATENT DOCUMENTS 633634 10/1963 Belgium .
36 28 963 A 3/1988 Germany .
2 093735 A 9/1982 United Kingdom .

*Primary Examiner*—Thomas M. Lithgow
*Attorney, Agent, or Firm*—Killworth, Gottman, Hagan & Schaeff, LLP

[57] ABSTRACT

A froth flotation method is provided for removing carbon from fly ash which utilizes an environmental friendly conditioning agent. The conditioning agent preferably comprises a biodegradable oil which is added to a slurry containing raw fly ash and water. The conditioning agent renders the carbon in the fly ash hydrophobic such that upon aeration of the slurry, air bubbles attach to the carbon particles and carry them to the surface of the slurry in the form of a froth, such that the carbon may be removed.

6 Claims, 1 Drawing Sheet

METHOD OF REMOVING CARBON FROM FLY ASH

CROSS REFERENCE TO RELATED APPLICATIONS

This application claims the benefit of U.S. provisional application Serial No. 60/092,599, filed Jul. 13, 1998.

BACKGROUND OF THE INVENTION

The present invention relates to a froth flotation method of removing carbon from fly ash, and more particularly, to an improved method which utilizes an environmentally friendly conditioning agent to aid in removing carbon from the fly ash.

Fly ash is a combustion residue generated from utilities which burn coal, oil, or other solid fuels. It consists of fine particles of various mineral matters and unburned carbon. Electrostatic precipitators, cyclones, and baghouses are commonly used to collect fly ash particles from combustion emissions. The chemical composition and particle size distribution of fly ash varies widely, depending on the source of fuel, fuel preparation conditions, combustor, and combustion conditions. The mineral components are mostly silicates, comprising oxides of silicon, aluminum, iron, calcium, magnesium, potassium, sodium and others, but can also include metal oxides such as vanadium oxide.

The carbon content of fly ash usually varies from about 0.5 to 20%, although carbon contents of up to 50% have been reported. The content varies, depending on combustion efficiency. In order to meet the low nitrogen oxide emissions requirement, many utilities have decreased the combustion temperature and/or oxygen supply during combustion, which has resulted in fly ash having a higher carbon content. However, the high carbon content in fly ash has frequently limited the use of fly ash in concrete applications as the carbon adsorbs air entraining agents in concrete and subsequently decreases the air content of concrete, which can cause the concrete to crack easily during freeze and thawing cycles. Therefore, it is desirable to separate carbon from fly ash for most applications.

Froth flotation has been found to be an effective method for the separation of carbon from fly ash. In a typical froth flotation system, fly ash is mixed with water to form a slurry and a flotation reagent such as oil is then added to the slurry. While mixing, oil droplets are adsorbed and coat the carbon particles and render them hydrophobic. Air is then introduced to the slurry in a froth flotation machine, and air bubbles attach to the hydrophobic particles and carry them to the surface of the slurry, which is then skimmed off such that the carbon is separated.

The selection of flotation reagents is critical for the froth flotation separation. Many different oils have been proposed for use as froth flotation reagents. For example, U.S. Pat. No. 4,121,945 discloses the use of kerosene oil; U.S. Pat. No. 4,426,282 discloses the use of mineral oil, U.S. Pat. No. 5,047,145 discloses the use of fuel oil, and U.S. Pat. No. 5,456,363 discloses the use of a mixture of fuel oil and petroleum sulfonate. All of these patents are hereby incorporated by reference generally with regard to froth flotation processes and equipment. However, the oils disclosed in these patents are not environmentally friendly as they are all petroleum based and are not easily biodegradable.

Accordingly, there is still a need in the art for an environmentally friendly method of removing carbon from fly ash.

SUMMARY OF THE INVENTION

The present invention meets that need by providing a froth flotation method for removal of carbon from fly ash which utilizes an environmentally friendly conditioning agent which contains no toxic aromatic compounds. The resulting fly ash has a low carbon content which allows its use in concrete and related applications, and the recovered carbon may also be used in a number of applications.

According to one aspect of the present invention, the method includes the steps of mixing raw fly ash containing carbon with water to form a slurry. Preferably, the slurry comprises from about 0.1 to 70% by weight fly ash and from about 30 to 99% by weight water. A conditioning agent which is free of toxic aromatic compounds is added to the slurry. A flotation reagent is also added to the slurry, and the slurry is aerated to form a froth containing carbon. The carbon is then removed from the slurry. The remaining fraction of the fly ash preferably contains less than 3% by weight carbon, and more preferably, less than about 1% by weight carbon.

The conditioning agent preferably comprises a biodegradable oil, and is preferably selected from the group consisting of lard oil, tallow oil, tung oil, and castor oil. The conditioning agent is preferably added in an amount of from about 1 to 10 lbs/ton of raw fly ash. The biodegradable oil renders the residual carbon particles in the raw fly ash hydrophobic such that when a frothing agent is added, the slurry is aerated, the carbon particles rise to the surface of the conditioning tank and can be skimmed off. The recovered carbon particles may then be reused for energy production or recycled for other applications.

The flotation reagent functions to stabilize the air bubbles formed during aeration and is preferably added in amounts of from 0.01 to 10 lbs/ton of raw fly ash. Preferred flotation reagents include glycols, alcohols, pine oil, ethers, and coal flotation reagents.

Accordingly, it is a feature of the present invention to provide a method for removing carbon from fly ash which utilizes an environmentally friendly conditioning agent. This, and other features and advantages of the present invention will become apparent from the following detailed description, the accompanying drawing, and the appended claims.

DETAILED DESCRIPTION OF THE PREFERRED EMBODIMENT

Figure 1:
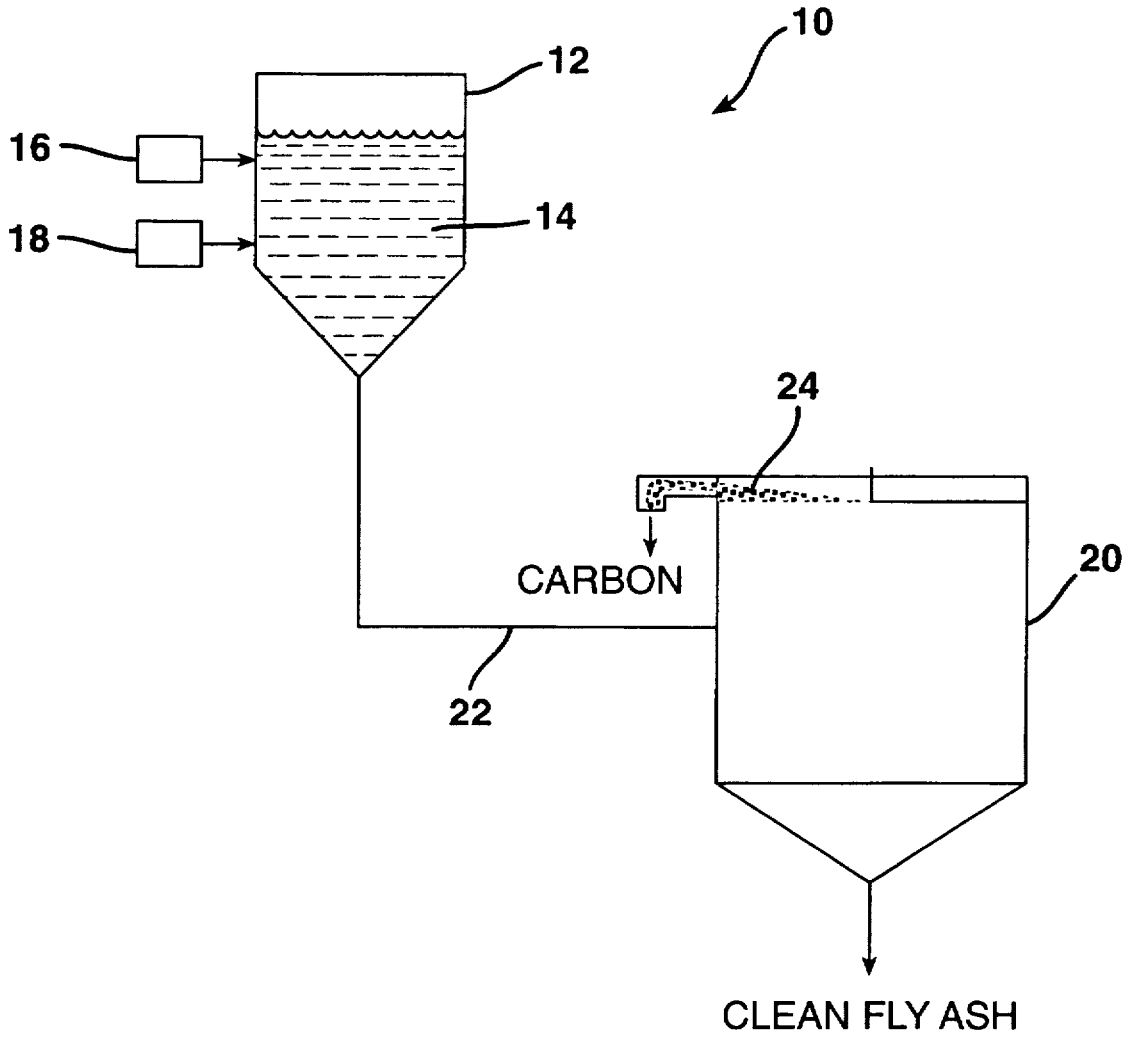
FIG. 1 is a schematic illustration of a flotation apparatus which may be used in accordance with the method of the present invention.

By using an environmentally friendly conditioning agent in the froth flotation process of the present invention, pollution resulting from the operation can be reduced or eliminated. Further, marketability of the separation products is enhanced. For example, the water used in the separation process can be safely discharged to a sewage plant.

The conditioning agent preferably comprises a biodegradable oil. Environmentally friendly biodegradable oils suitable for use in the present invention include animal and vegetable oils including lard, tallow oil, tung oil, and castor oil. Suitable biodegradable oils include those which are in liquid form at room temperature and which can be melted at elevated temperatures; for example, fats, waxes, lipids, etc. Also suitable for use in the present invention are synthetic oils produced from organic materials. For example, fatty acids can be used to produce esters, amides, and anhydrides through various olysis reactions.

The biodegradable oils can be utilized alone or blended together. The biodegradable oils can also be blended with surfactants or other chemicals to assist their emulsification in the slurry. Emulsified biodegradable oils offer an advantage in that lower amounts of oil may be used.

The biodegradable oil renders the residual carbon particles in the raw fly ash hydrophobic such that when the slurry is aerated, the carbon particles rise to the surface of the conditioning tank and can be skimmed off.

There are a number of commercially available flotation reagents, or frothers, which are suitable for use in the present invention. Examples of such frothers are DOWFROTH 250, which is a polypropylene glycol methyl ether, available from Dow Chemical Company, Midland, Mich.; UNIFROTH 250C, which is a glycol ether-based frother available from Huntsman Corporation, Houston, Tex.; NALCO 9847 coal flotation reagent or NALCO 97DU086 coal flotation frother from Nalco Chemical Company, Naperville, Ill.; and AERO-FROTH 65, 70, 73, 76, 77, 88, and 4166, all available from Cytec Industries Inc. of Stamford, Conn.

Any conventional flotation cell apparatus is suitable for use in the present invention including agitation tank flotation systems and column flotation systems. One example of a suitable apparatus is available from Denver Equipment Division, Denver, Colo. under the tradename D-R Denver Flotation.

Referring now to FIG. 1, the method of the present invention is illustrated. First, raw fly ash containing carbon is mixed with water either prior to or after placement in a conditioning tank 12 of a flotation apparatus 10 to produce a slurry 14. The slurry preferably comprises about 1 to 70% by weight raw fly ash and from about 30 to 99% by weight water.

Next, the conditioning agent 16 is added to the slurry to condition the carbon and render it hydrophobic. The conditioning agent may be pumped through a feed line for mixing with the slurry. The conditioning agent is preferably added in an amount of about 0.1 to 10 lbs/ton of raw fly ash, and more preferably from about 1 to 3 lbs/ton.

The flotation reagent 18 is then added to the slurry. The flotation reagent may also be pumped through a feed line and is preferably added in an amount comprising 0.01 to 100 lbs/ton of raw fly ash.

An agitator or other device (not shown) may be utilized to agitate the slurry in the conditioning tank 12. The conditioned slurry may then be transferred to a flotation cell 20 through a feed line 22. The slurry is then aerated, for example, by conventional air injection or agitation. As bubbles are formed and begin to rise, the carbon which has been made hydrophobic by the conditioning agent attaches to the air bubbles and is carried upward in the flotation cell to form a froth 24 which collects on the surface of the slurry. The carbon in the froth may then be filtered and dried, and then reused in a number of products including coke, charcoal briquets, or as an adsorption agent. The remaining product in the flotation cell may then be filtered and dried to form a clean ash product for use in concrete applications.

While the method has been described herein as directed to the removal of carbon from fly ash, it should be appreciated that the use of the conditioning agent may also be used in the removal of carbon in the processi

* * * * *

UNITED STATES PATENT OFFICE
PTO - BOYERS, PA DUTY STATION

---

MISSING PAGE TEMPORARY NOTICE

PATENT NUMBER 6068131 FOR THE ISSUE DATE OF 5/30/2000 HAS BEEN SCANNED, BUT CONTAINS A MISSING PAGE TEMPORARY NOTICE. UPON RECEIPT OF THE MISSING PAGE(S), THE ENTIRE DOCUMENT WILL BE RESCANNED. IF YOU HAVE ANY QUESTIONS, PLEASE CONTACT DENEISE BOYD OF THE DATA MAINTENANCE BRANCH DATA CENTER OPERATIONS DIVISION (DMB) BY E-MAIL AT HER ADDRESS DENEISEBOYD@USPTO.GOV OR BY PHONE (703) 306-3116.

THIS NOTICE IS FOR THE MISSING PAGE CONTAINING:

Col. 5 thru end (missing claims)

DATA CONVERSION OPERATION
BOYERS, PA

UNITED STATES PATENT AND TRADEMARK OFFICE

CERTIFICATE OF CORRECTION

PATENT NO. : 6,068,131
DATED : May 30, 2000
INVENTOR(S) : Robert William Styron et al.

It is certified that error appears in the above-identified patent and that said Letters Patent is hereby corrected as shown below:

Title page,
Delete the entire specification and substitute therefore the attached specification.

Signed and Sealed this

Seventeenth Day of December, 2002

JAMES E. ROGAN
*Director of the United States Patent and Trademark Office*

METHOD OF REMOVING CARBON FROM FLY ASH

CROSS REFERENCE TO RELATED APPLICATIONS

This application claims the benefit of U.S. provisional application Ser. No. 60/092,599, filed Jul. 13, 1998.

BACKGROUND OF THE INVENTION

The present invention relates to a froth flotation method of removing carbon from fly ash, and more particularly, to an improved method which utilizes an environmentally friendly conditioning agent to aid in removing carbon from the fly ash.

Fly ash is a combustion residue generated from utilities which burn coal, oil, or other solid fuels. It consists of fine particles of various mineral matters and unburned carbon. Electrostatic precipitators, cyclones, and baghouses are commonly used to collect fly ash particles from combustion emissions. The chemical composition and particle size distribution of fly ash varies widely, depending on the source of fuel, fuel preparation conditions, combustor, and combustion conditions. The mineral components are mostly silicates, comprising oxides of silicon, aluminum, iron, calcium, magnesium, potassium, sodium and others, but can also include metal oxides such as vanadium oxide.

The carbon content of fly ash usually varies from about 0.5 to 20%, although carbon contents of up to 50% have been reported. The content varies, depending on combustion efficiency. In order to meet the low nitrogen oxide emissions requirement, many utilities have decreased the combustion temperature and/or oxygen supply during combustion, which has resulted in fly ash having a higher carbon content. However, the high carbon content in fly ash has frequently limited the use of fly ash in concrete applications as the carbon adsorbs air entraining agents in concrete and subsequently decreases the air content of concrete, which can cause the concrete to crack easily during freeze and thawing cycles. Therefore, it is desirable to separate carbon from fly ash for most applications.

Froth flotation has been found to be an effective method for the separation of carbon from fly ash. In a typical froth flotation system, fly ash is mixed with water to form a slurry and a flotation reagent such as oil is then added to the slurry. While mixing, oil droplets are adsorbed and coat the carbon particles and render them hydrophobic. Air is then introduced to the slurry in a froth flotation machine, and air bubbles attach to the hydrophobic particles and carry them to the surface of the slurry, which is then skimmed off such that the carbon is separated.

The selection of flotation reagents is critical for the froth flotation separation. Many different oils have been proposed for use as froth flotation reagents. For example, U.S. Pat. No. 4,121,945 discloses the use of kerosene oil; U.S. Pat. No. 4,426,282 discloses the use of mineral oil, U.S. Pat. No. 5,047,145 discloses the use of fuel oil, and U.S. Pat. No. 5,456,363 discloses the use of a mixture of fuel oil and petroleum sulfonate. All of these patents are hereby incorporated by reference generally with regard to froth flotation processes and equipment. However, the oils disclosed in these patents are not environmentally friendly as they are all petroleum based and are not easily biodegradable.

Accordingly, there is still a need in the art for an environmentally friendly method of removing carbon from fly ash.

SUMMARY OF THE INVENTION

The present invention meets that need by providing a froth flotation method for removal of carbon from fly ash which utilizes an environmentally friendly conditioning agent which contains no toxic aromatic compounds. The resulting fly ash has a low carbon content which allows its use in concrete and related applications, and the recovered carbon may also be used in a number of applications.

According to one aspect of the present invention, the method includes the steps of mixing raw fly ash containing carbon with water to form a slurry. Preferably, the slurry comprises from about 0.1 to 70% by weight fly ash and from about 30 to 99% by weight water. A conditioning agent which is free of toxic aromatic compounds is added to the slurry. A flotation reagent is also added to the slurry, and the slurry is aerated to form a froth containing carbon. The carbon is then removed from the slurry. The remaining fraction of the fly ash preferably contains less than 3% by weight carbon, and more preferably, less than about 1% by weight carbon.

The conditioning agent preferably comprises a biodegradable oil, and is preferably selected from the group consisting of lard oil, tallow oil, tung oil, and castor oil. The conditioning agent is preferably added in an amount of from about 1 to 10 lbs/ton of raw fly ash. The biodegradable oil renders the residual carbon particles in the raw fly ash hydrophobic such that when a frothing agent is added, the slurry is aerated, the carbon particles rise to the surface of the conditioning tank and can be skimmed off. The recovered carbon particles may then be reused for energy production or recycled for other applications.

The flotation reagent functions to stabilize the air bubbles formed during aeration and is preferably added in amounts of from 0.01 to 10 lbs/ton of raw fly ash. Preferred flotation reagents include glycols, alcohols, pine oil, ethers, and coal flotation reagents.

Accordingly, it is a feature of the present invention to provide a method for removing carbon from fly ash which utilizes an environmentally friendly conditioning agent. This, and other features and advantages of the present invention will become apparent from the following detailed description, the accompanying drawing, and the appended claims.

BRIEF DESCRIPTION OF THE DRAWINGS

FIG. 1 is a schematic illustration of a flotation apparatus which may be used in accordance with the method of the present invention.

DETAILED DESCRIPTION OF THE PREFERRED EMBODIMENT

By using an environmentally friendly conditioning agent in the froth flotation process of the present invention, pollution resulting from the operation can be reduced or eliminated. Further, marketability of the separation products is enhanced. For example, the water used in the separation process can be safely discharged to a sewage plant.

The conditioning agent preferably comprises a biodegradable oil. Environmentally friendly biodegradable oils suitable for use in the present invention include animal and vegetable oils including lard, tallow oil, tung oil, and castor oil. Suitable biodegradable oils include those which are in liquid form at room temperature and which can be melted at elevated temperatures; for example, fats, waxes, lipids, etc. Also suitable for use in the present invention are synthetic oils produced from organic materials. For example, fatty acids can be used to produce esters, amides, and anhydrides through various olysis reactions.

The biodegradable oils can be utilized alone or blended together. The biodegradable oils can also be blended with surfactants or other chemicals to assist their emulsification in the slurry. Emulsified biodegradable oils offer an advantage in that lower amounts of oil may be used.

The biodegradable oil renders the residual carbon particles in the raw fly ash hydrophobic such that when the slurry is aerated, the carbon particles rise to the surface of the conditioning tank and can be skimmed off.

There are a number of commercially available flotation reagents, or frothers, which are suitable for use in the present invention. Examples of such frothers are DOWFROTH 250, which is a polypropylene glycol methyl ether, available from Dow Chemical Company, Midland, Mich.; UNIFROTH 250C, which is a glycol ether-based frother available from Huntsman Corporation, Houston, Tex.; NALCO 9847 coal flotation reagent or NALCO 97DU086 coal flotation frother from Nalco Chemical Company, Naperville, Ill.; and AERO-FROTH 65, 70, 73, 76, 77, 88, and 4166, all available from Cytec Industries Inc. of Stamford, Conn.

Any conventional flotation cell apparatus is suitable for use in the present invention including agitation tank flotation systems and column flotation systems. One example of a suitable apparatus is available from Denver Equipment Division, Denver, Colo. under the tradename D-R Denver Flotation.

Referring now to FIG. 1, the method of the present invention is illustrated. First, raw fly ash containing carbon is mixed with water either prior to or after placement in a conditioning tank 12 of a flotation apparatus 10 to produce a slurry 14. The slurry preferably comprises about 1 to 70% by weight raw fly ash and from about 30 to 99% by weight water.

Next, the conditioning agent 16 is added to the slurry to condition the carbon and render it hydrophobic. The conditioning agent may be pumped through a feed line for mixing with the slurry. The conditioning agent is preferably added in an amount of about 0.1 to 10 lbs/ton of raw fly ash, and more preferably from about 1 to 3 lbs/ton.

The flotation reagent 18 is then added to the slurry. The flotation reagent may also be pumped through a feed line and is preferably added in an amount comprising 0.01 to 100 lbs/ton of raw fly ash.

An agitator or other device (not shown) may be utilized to agitate the slurry in the conditioning tank 12. The conditioned slurry may then be transferred to a flotation cell 20 through a feed line 22. The slurry is then aerated, for example, by conventional air injection or agitation. As bubbles are formed and begin to rise, the carbon which has been made hydrophobic by the conditioning agent attaches to the air bubbles and is carried upward in the flotation cell to form a froth 24 which collects on the surface of the slurry. The carbon in the froth may then be filtered and dried, and then reused in a number of products including coke, charcoal briquets, or as an adsorption agent. The remaining product in the flotation cell may then be filtered and dried to form a clean ash product for use in concrete applications.

While the method has been described herein as directed to the removal of carbon from fly ash, it should be appreciated that the use of the conditioning agent may also be used in the removal of carbon in the processing of minerals or inorganic materials such as coal and silicon carbide processing.

In order that the invention may be more readily understood, reference is made to the following examples, which are intended to be illustrative of the invention, but are not intended to be limiting in scope.

EXAMPLE 1

A fly ash sample from Baltimore Gas and Electric was obtained which contained 7.41% LOI (Loss on Ignition, which is almost equivalent to carbon content). About 220 g of the sample was mixed with one liter of water in a Denver flotation machine. About 0.1 g of lard oil was added and mixed with the slurry. After 5 minutes of mixing, 0.15 g of Dowfroth 250 Flotation Frother (propylene glycol methyl ether) was added and the mixing continued for another minute. Air was then introduced into the machine to float the carbon for 5 minutes. The cell product, which contained the materials that didn't float, was filtered, dried and designated as the clean ash. The froth product was placed in the froth flotation machine again and air was introduced to refloat the material for another 6 minutes. The materials in the cell were filtered, dried, and designated as the middling. The second froth product was filtered, dried and designated as the carbon concentrate. Analysis of these products are shown in Table 1.

TABLE 1

| Products | Weight % | LOI % |
|---|---|---|
| Clean Ash | 77.64 | 0.42 |
| Middling | 9.0 | 1.26 |
| Carbon concentrate | 13.36 | 52.13 |

As will be appreciated, repeated processing of the fly ash will result in a product having a lower carbon content, and repeated processing of the clean carbon will increase the carbon content of the carbon concentrate.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A froth flotation method for removing carbon from fly ash comprising the steps of:

mixing raw fly ash containing carbon with water to form a slurry;

adding a conditioning agent to said slurry, said conditioning agent being free of toxic aromatic compounds and said conditioning agent being selected from the group consisting of lard oil, tallow oil, tung oil and castor oil;

adding a flotation reagent to said slurry;

aerating said slurry to form a froth containing carbon; and removing said carbon from said slurry.

2. The method of claim 1 wherein said slurry comprises from about 0.1 to 70% by weight raw fly ash and from about 30 to 99% by weight water.

3. The method of claim 1 wherein said flotation reagent is added in an amount of about 0.01 to 100 lbs/ton of raw fly ash.

4. The method of claim 1 wherein said conditioning agent is added in an amount of about 0.1 to 10 lbs/ton of raw fly ash.

5. The method of claim 1 wherein the fraction of said fly ash remaining after said carbon removal contains less than about 3% carbon.

6. The method of claim 1 wherein said fraction of said fly ash remaining after said carbon removal contains less than about 1% carbon.

* * * * *